US005358048A

United States Patent [19]

Brooks

[11] Patent Number: 5,358,048

[45] Date of Patent: Oct. 25, 1994

[54] HYDRAULIC PORT COLLAR

[75] Inventor: Robert T. Brooks, Houston, Tex.

[73] Assignee: CTC International, Houston, Tex.

[21] Appl. No.: 52,618

[22] Filed: Apr. 27, 1993

[51] Int. Cl.[5] ..... E21B 33/00

[52] U.S. Cl. ..... 166/285

[58] Field of Search ..... 166/285, 317–320, 166/321, 332, 334

[56] References Cited

U.S. PATENT DOCUMENTS 4,602,684 7/1986 Wormer et al. ..... 166/285

*Primary Examiner*—Michael Powell Buiz

*Attorney, Agent, or Firm*—Donald H. Fidler

[57] ABSTRACT

A stage valve with particular use in cementing a well bore annulus above an inflatable packer located in a well bore on a liner where the stage valve has pressure operated outer sleeve members for opening a flow port in the stage valve and an inner sleeve member actuated by the trailing plug behind a liquid cement slurry to close the flow port whereupon spring members act on at least one of the outer sleeve members to close off the flow port on the exterior of the stage valve.

23 Claims, 5 Drawing Sheets

HYDRAULIC PORT COLLAR

FIELD OF THE INVENTION

This invention relates to oil well completions and more particularly, to a hydraulic port collar system which has utility in the cementing of liners in a wellbore or for introducing cement to a wellbore annulus at locations intermediate of the length of a liner string and at locations above, below, and between inflatable packers.

BACKGROUND OF THE INVENTION

In oil well completions, it is common to line the borehole with a tubular metal liner and to cement the annulus between the liner and the borehole by injecting a liquid cement slurry under pressure through the bottom end of the liner into the annulus between the liner and the wellbore. The liquid slurry is moved up the annulus between the liner and the wellbore under pressure and subsequently sets up in the annulus to support the liner in the well bore. There are limitations as to the length or height of a column of cement which can be pumped into a well annulus. Where the length of the liquid cement column in an annulus is too long it is not uncommon to insert a stage cementing collar along the length of the liner. In this instance, a liquid cement slurry is first located between the end of the liner, and the stage collar. Next, the stage collar is opened and liquid cement slurry is injected into the annulus located above the stage collar. After cementing the upper annulus above the stage collar, the stage collar is closed off to prevent a return flow of the liquid slurry into the bore of the liner.

In other completion techniques, an inflatable well packer is disposed in a wellbore on a liner where an inflation liquid is utilized to inflate an elastomer element on the packer and where the elastomer element seals off the annulus of the wellbore. In some instances, it is desirable to have a stage valve above the inflatable packer so that cement can be introduced into the upper annulus between the liner and the wellbore above the inflatable packer.

Stage valves require the ability to remain closed during an initial operations and to be opened only at an appropriate time and to be closed securely at the end of an appropriate time. Stage valves typically include sliding sleeves and latches for retaining the sleeves in one position or another. The sleeves and latches can be mechanically activated or hydraulically activated. However, as with all downhole tools, it is always a problem to determine whether or not a stage collar has safely and reliably performed its function in the wellbore. It is also a problem if the stage valve fails to remain closed.

In most types of cementing operations it is also common to leave cement in the liner which has to be drilled out. Thus, if cementing can be accomplished without leaving cement in the liner, there are substantial economic benefits to the operator.

PRIOR PATENT ART

U.S. Pat. No. 4,655,286 issued Apr. 7, 1989, to E. T. Wood (Class 166/396) discloses a cementing system which utilizes an inflatable packer and a cementing process for a liner U.S. Pat. No. 5,048,611 issued Sep. 17, 1991, to C. B. Cochran discloses a pressure operated circulation valve where a tubular valve member with flow ports has outer telescoping sleeve members and an inner ball seating members. By use of a first sealing ball and pressure, the outer telescoping sleeve members separate to open the flow ports. A second sealing ball and pressure enables movement of an outer sleeve to close the flow ports.

U.S. Pat. No. 4,880,058 issued on Nov. 14, 1989, to H. E. Lindsey (Class 166/289) discloses a stage valve which is pressure operated to open flow ports. The valve sleeve moves upwardly to open the ports and releases a locking mechanism. A cementing plug is used to shift the valve sleeve to a closed position.

SUMMARY OF THE INVENTION

The present invention is embodied in a hydraulic port valve or port collar which is preferably utilized with an inflatable packer and is selectively operable to introduce a liquid cement slurry to the annulus between a liner and a well bore at the location of the port collar.

The port collar structure includes a tubular valve member with circumferentially arranged flow ports. The flow ports are initially closed off by telescoping outer sleeve members which are releasably and slidably mounted on the valve member. When pressure is applied in the bore of the valve member, the pressure is applied through the flow ports to separate the outer sleeve members relative to one another independently of an outer closing seal on the valve member and to open the flow ports to the exterior of the valve member. At least one of the outer sleeve members is held in a separated position against an opposing spring force by the applied pressure. A cement slurry can be passed through the flow ports under pressure to fill an annulus between the port collar and the well bore. When the pressure holding the one outer sleeve member in a separated position is released, the spring force on the one outer sleeve member positively closes the flow ports on the valve member with respect to the exterior of the valve member.

A trailing cementing plug is behind and following the cement slurry and is utilized to move a releasable and slidable inner sleeve member into a position closing off the flow ports in the interior of the valve member. The inner sleeve member can be locked in a closed position. With the flow ports closed off internally and externally, differential pressure will not move the closed valve members.

In a broader aspect of the present invention, the port collar and inflatable packer can be operated by an inflation tool. For example, a port collar can be disposed between two inflatable packers. By using an inflation tool on a string of tubing, the respective packers can be inflated with an inflation liquid on a first trip in the well bore. In a second trip in the well bore with the inflating tool on a string of tubing, cement slurry can be injected through the port collar so that the annulus between the inflated packers can be filled with cement. When the annulus is filled with the cement slurry, the port collar is closed off. Then, the string of tubing and inflation tool are returned to the surface together with the cement slurry, or alternatively, the cement slurry can be reversed out of the tubing string and, in either case, no cement is left in the well bore.

A single inflatable packer and port collar can be operated by an inflation tool. An inflation tool will utilize a profile recess associated with a packer and a port collar to locate the tool. The inflation tool can utilize either cup type or weight set packing elements.

DESCRIPTION OF THE PRESENT INVENTION

Figure 1:
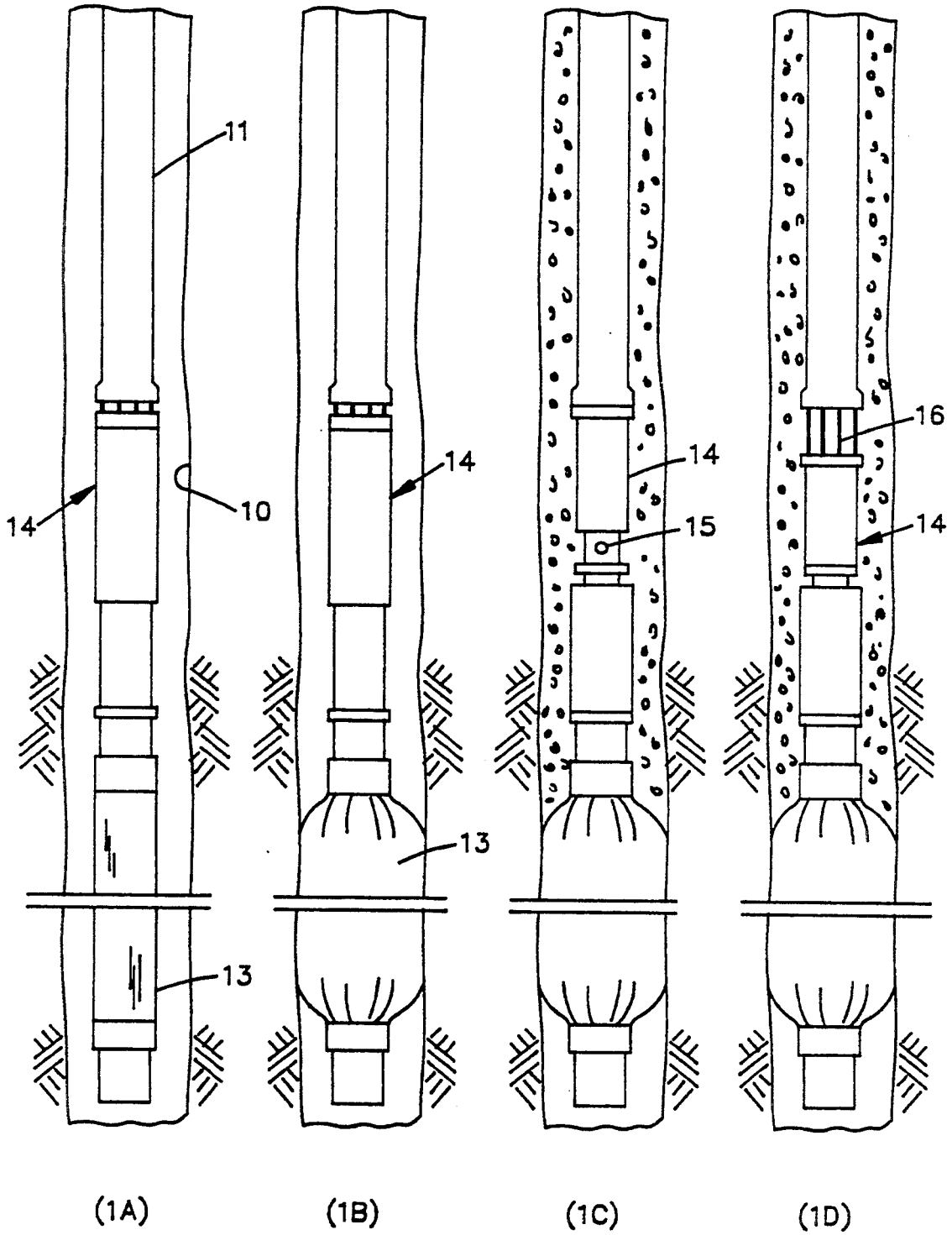
FIGS. 1 (A)-(D) are schematic illustrations of an inflatable packer with a hydraulic port collar: (A) prior to inflating the packer; (B) after the packer is inflated; (C) with the hydraulic port collar open; and (D) with the hydraulic port collar closed.

Referring now to FIG. 1A, a wellbore 10 is illustrated with a liner 11 disposed in the wellbore where the liner carries an inflatable packer 13 along its length and a port collar 14 is located in the liner string just above the inflatable packer 13. At the desired location in the wellbore to inflate the packer 13, a liquid cement slurry (or other inflating liquid) is pumped through the liner under pressure to inflate the inflatable packer 13 into a sealing condition on the wellbore 10 (See FIG. 1B). The port collar is designed to remain closed under this cement slurry pressure. An inflatable packer of the type contemplated can be found in U.S. Pat. No. 4,655,286 or 4,420,159 where a pressure operated valve is utilized rather than a knock off plug to control access of inflating liquid to the well packers.

After the packer is inflated, pressure on the cement slurry is utilized to open the port collar valve (See FIG. 1C) to open flow ports 15 and to hold an external sleeve on the port collar in an open position where springs 16 on the port collar are compressed. When the pressure is decreased below the force of the springs, the external sleeve is moved by the spring force to close the flow ports 15. A trailing cementing dart is utilized to close the port collar ports 15 internally.

Figure 2:
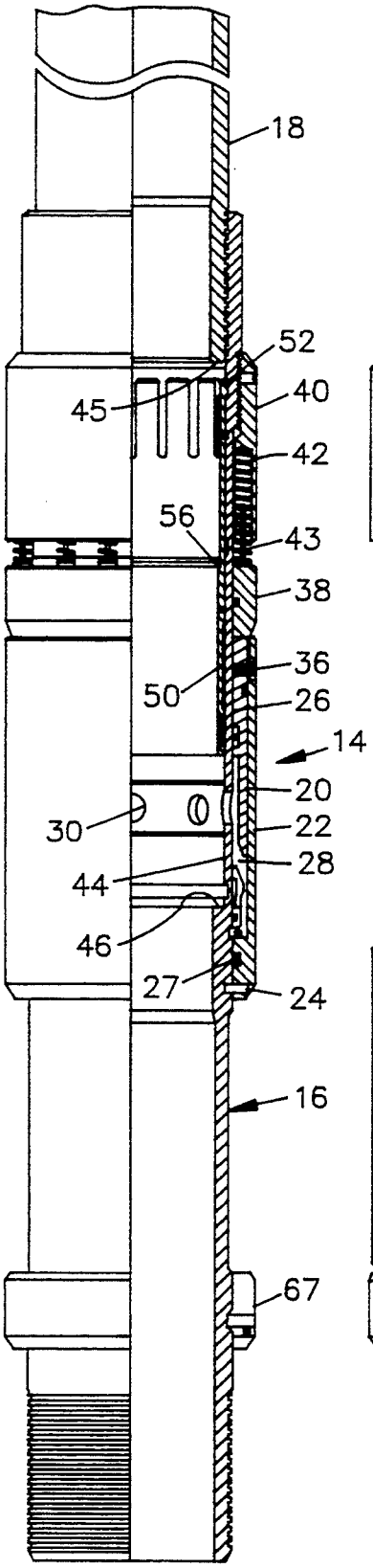
FIG. 2 is a view in partial longitudinal cross-section through a hydraulic port collar embodying the present invention.
Figure 3:
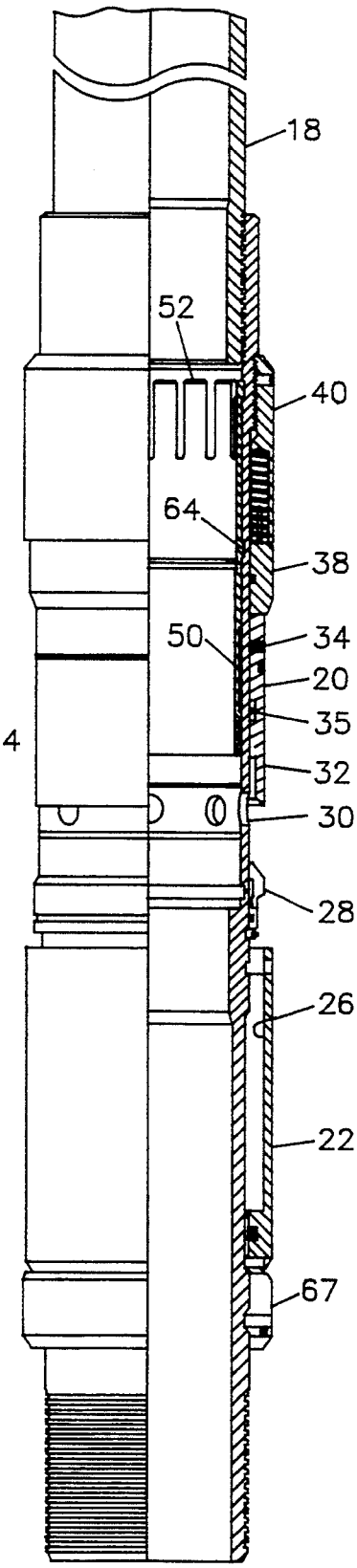
FIG. 3 is a view similar to FIG. 3 showing the port collar of FIG. 2 in an open position.
Figure 4:
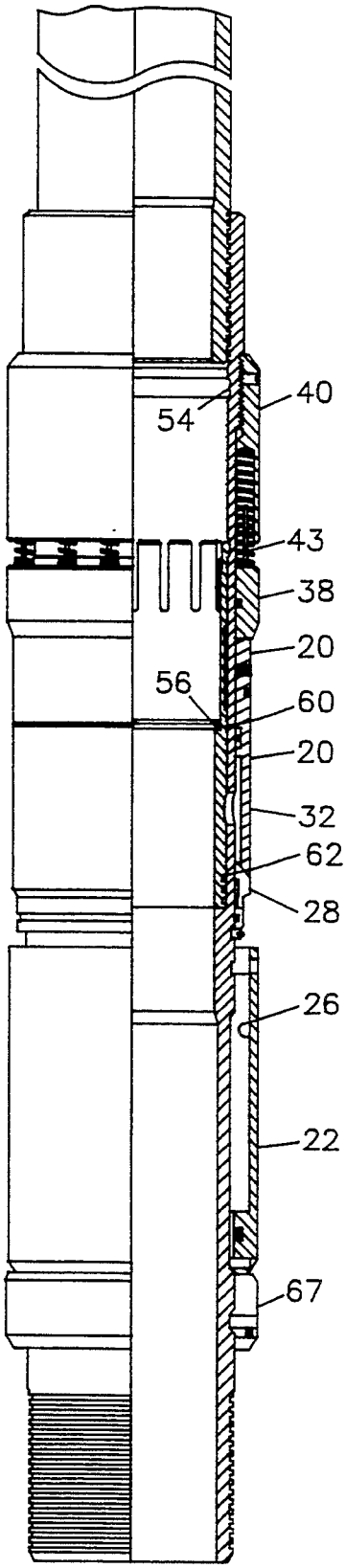
FIG. 4 is a view similar to FIG. 3 but showing the port collar in a closed position after cementing.
Figure 5:
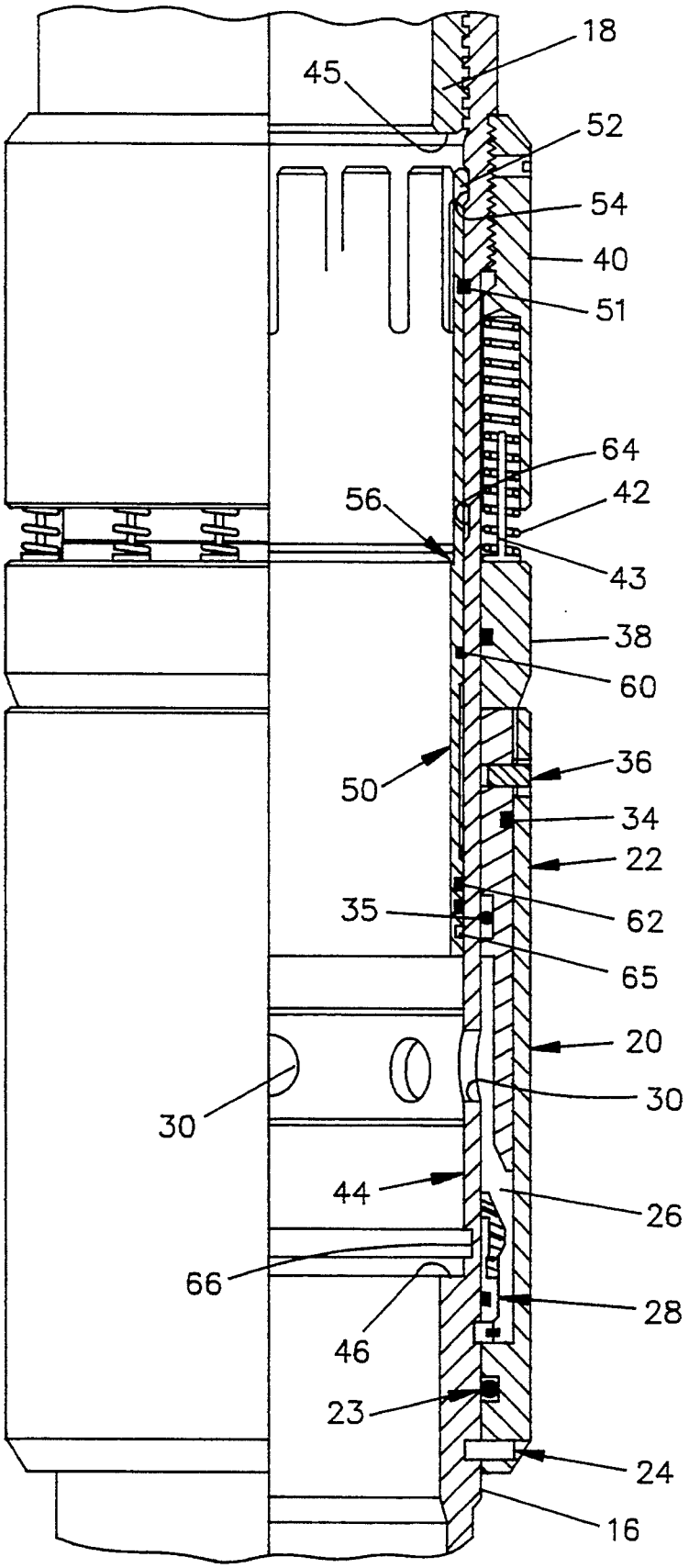
FIG. 5 is an enlarged view in partial cross-section through a port collar embodying the present invention.

Referring now to FIGS. 2, 3, and 4, a port collar valve 14 embodying the present invention is shown in various operating positions and an enlarged cross-section of the port collar 14 is shown in FIG. 5. The port collar 14 includes a tubular valve member 16 which is adapted for coupling with a liner or string of pipe 18. On the exterior of the tubular valve member 16 there are overlapping, longitudinally movable, telescopic sleeve members 20, 22. The lower sleeve member 22 is shear pinned at 24 to the valve member 16 and has an inner counterbore recess 26. A sealing element 27 seals the sleeve member 22 with respect to the outer surface of the tubular valve member 16 in the "run" position. Disposed within the lower end of the recess 26 is an annular closing seal means 28 which is attached to the valve member 16. Both the sealing element 27 and seal means 28 are located below flow ports 30 in the valve member 16.

The upper sleeve member 20 has a tubular portion 32 which is sealingly and slidably received in the counterbore recess 26 with sealing elements 34,35 located above the flow ports 30. The upper sleeve member 20 is shear pinned at 36 to the lower sleeve member 22. The upper end of the upper sleeve member 20 is engaged by a closing collar 38 which is slidably and sealingly mounted on the tubular valve member 16. Above the upper closing collar 38 is an annular housing 40 to which contains a number circumference arranged, longitudinally extending springs 42 which are located in blind bores. Pins 43 are provided to maintain vertical alignment of the springs 42. The flow ports 30 are in a closed condition as shown in FIG. 2 and FIG. 5.

The tubular valve member 16 has an internal annular recessed wall 44 located between upper and lower shoulders 45,46. The circumferentially arranged flow ports 30 which access fluids through the wall of the tubular valve member 16 are located near the lower shoulder 46 of the recessed wall 44. An inner tubular sleeve member 50 is slidably located within the recessed wall 44. In an upper position of the sleeve member 50, the lower end of the inner sleeve member 50 is displaced upwardly from the flow ports 30. The inner sleeve member 50 has, as its upper end, collet finger latches 52 which normally engage with an annular groove 54 in the valve member 16. The inner sleeve member 50 has an upwardly facing internal shoulder 56 which can be engaged by a cementing dart so the sleeve member 50 can be shifted downwardly by pressure behind the dart to move the collet fingers 52 out of the annular recess 54 and to permit downward movement of the inner sleeve member 50, to a position where the flow ports 30 in the valve member are closed and sealed off between "O" rings 60, 62 on the inner sleeve member 50. In the lowermost position of the inner sleeve member 50, the collet latching fingers 52 engage a second annular groove 64 in the valve member 16 and lock the sleeve member in a closed position.

Alternatively, instead of collet fingers, (or supplentally to the collet fingers) a shear pin 51 can be used to hold the inner sleeve member 50 in an upper position. With this arrangement, a resilient split ring 65 is located in an annular groove in the inner sleeve member and can resiliently expand to engage a latching groove 66 in the valve member 16 when the sleeve member is in a lower position.

When it is desired to open the flow ports 30 in the port collar, pressure is developed in the liner to exceed the sleeve pin strengths and open the port collar valve. In one type of situation, for example, the pressure is developed after passing a ball or cementing dart under pressure of a liquid cement slurry to a sealing seat or location (not shown) below the ports 36. Internal pressure in the string of pipe is then applied to the slurry and acts through the flow ports 30 and acts on the differential areas of the outer sleeve members 20, 22 (but not the closing seal 28) to cause the outer sleeve members 20, 22, to move from a contracted position (FIG. 2) to an extended position (FIG. 3) after the shear pins 24, 26 are sheared. When the applied pressure separates the two outer sleeve members 20, 22 the outer sleeve member 22 moves downwardly to engage a stop ring 67 on the valve member 16 and the upper sleeve member 20 is moved upwardly and compresses the springs 42 so that the flow ports 30 are opened. The flow ports 30 permit the flow of liquid slurry from the interior of the string of pipe to the exterior of the pipe under pressure (See FIG. 3). In a typical situation, the liquid cement slurry is preceded by a leading cementing dart and followed by trailing cementing dart. The springs 42 positively close the valve when the cementing is completed and the pressure is reduced.

When the trailing cementing dart engages the shoulder 56 in the inner sleeve member 50, the sleeve member 50 is shifted downwardly and locks in a lower position closing off the flow ports 30. When the sleeve member 50 is displaced downwardly to the closed position, the collet fingers 52 also engage the locking recess 64. In this position, the valve ports 30 are closed. When the valve ports 30 are closed by the inner sleeve member 50, the spring members 42 have resiliently biased the upper outer sleeve member 20 downwardly to a closed position where the end of the upper sleeve member 20 engages the seal means 28 and closes off the flow ports externally of the sleeve member 16.

In a co-pending application Ser. No. 08/040345, filed Mar. 30, 1993 entitled HORIZONTAL INFLATION TOOL, I have disclosed a cup type inflation tool with a selectively operated valve for the inflation of inflatable packers. The cup type inflation tool is run on a string of tubing to a location within an inflatable packer and selectively operated to admit cement slurry to the inflatable packer for inflation of the packer. After inflating the packer, the cement slurry can be reversed from the string of tubing by use of a circulation valve in the tubing string and the tool is retrieved on the string of tubing so that no cement is left in the liner.

In U.S. Pat. No. 5,082,062, I have developed an inflation tool for inflation of inflatable packer with expanding weight set packer elements and a selectively operated valve. This inflation tool is run in on a string of tubing and has a selectively operated valve for admitting cement slurry to an inflatable packer. Both the weight set inflation tool and the cup type inflation tool permit inflation without leaving cement in the liner.

When the hydraulic port collar of the present invention is combined with a profile collar it can be utilized with either of the above two types of inflation tools to achieve stage cementing and intermediate thief zone cementing without leaving cement in the liner.

Figure 6:
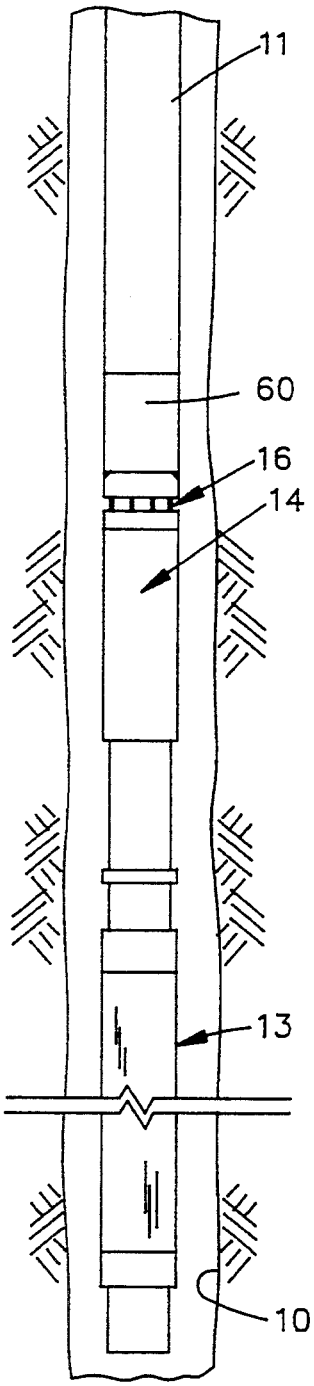
FIG. 6 is a schematic view of an inflatable packer and hydraulic port collar for use with straddle type inflation tools.

Referring now to FIG. 6, an inflatable packer 13 is shown as disposed in a wellbore 10. Above the packer 13 is a port collar 14 of the present invention. Above the port collar 14 is tubular profile sub 60, which in turn is connected to a string of pipe or liner 11.

Figure 7:
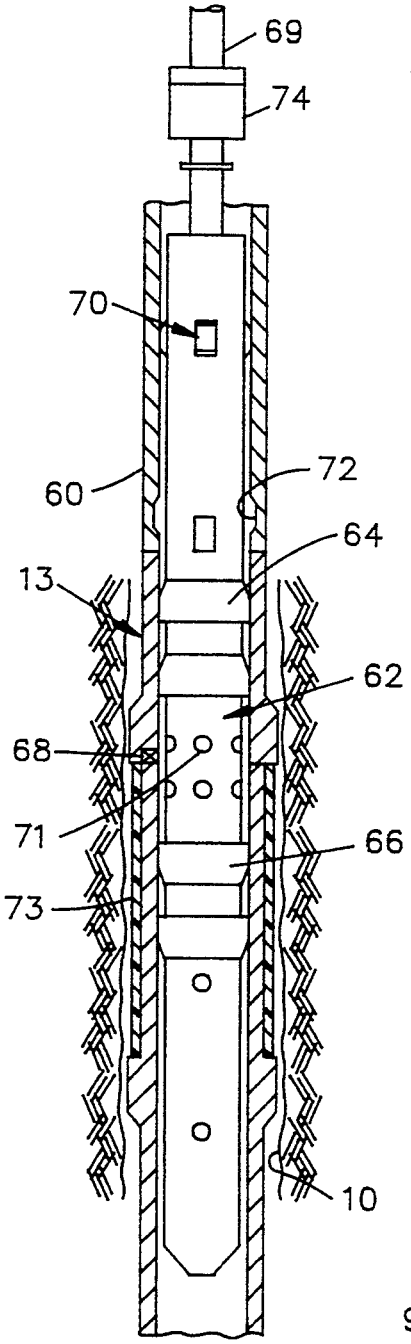
FIG. 7 is a schematic view of a cup type straddle inflation tool for use with inflatable packers and a hydraulic port collar to eliminate leaving cement in the liner.

As shown in FIG. 7, a cup type inflation tool 62 as disclosed in Ser. No. 08/040345 includes opposite facing sealing cup members 64, 66 which are arranged to straddle a valve opening for a pressure operated valve means 68 in the inflatable packer 62° The inflation tool has an upper latching means 70 which cooperates with an annular latching profile recess 72 in a profile sub member 60 to releasably position the inflation tool 62 relative to the valve means 68 in the adjacent packer. The inflation tool 62 is disposed in the liner by a string of tubing 69.

The inflation tool 62 is lowered by the string of tubing 69 to position and releasably lock the latching means in the profile recess 72. The cup members 64, 66 straddle or isolate the inflation valve means 68 in the bore of the inflatable packer 62. A valve means (not shown) in the inflation tool 62 is then activated so that a cement slurry in the string of tubing 69 can be introduced through valve ports 71 in the inflation tool to access the inflatable packer valve means 68 and thereby to expand the packer element 73 into sealing engagement with the wall of the well bore 10.

After expanding the inflatable packer, the element 73, the latching means 70 are released from the profile recess 72, the valve means 68 are closed and the tool 62 is raised to the profile sub 60 located above the port collar 14 (See FIG. 6). The inflation tool 60 is then repositioned so that the latching means 70 are in a profile recess in the profile sub 60 and the cup members 64, 66 straddle the valve port 30 of the port collar 14. The valve means in the inflation tool 62 is again opened so that cement slurry can be introduced through the port collar 14 to the annulus in the well bore above the inflated packer 13 . Upon completion of the cementing through the port collar 14, the pressure is reduced and the valve ports 30 in the port collar 14 are closed off. The spring members move the outer sleeve member 20, and when the inflation tool 62 is lowered, the anchor members 70 will engage the shoulder 56 in the inner sleeve member 50 to move the inner sleeve member 50 to a closed and locked condition. The tool 62 is then raised to a blank section of pipe and a reverse circulation valve 74 is opened and the cement slurry is reversed out through the string of tubing by pumping liquid down the annulus. Thus, no cement is left in the well bore from the operation.

Figure 8:
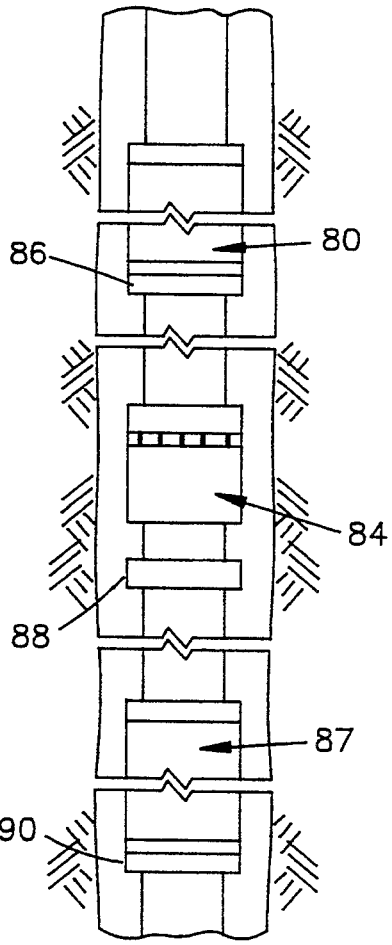
FIG. 8 is a schematic illustration of a well bore in which inflatable packers are located above and below a hydraulic port collar.

Referring now to FIG. 8, a different packer and port collar arrangement is illustrated. In FIG. 8, a pair of inflatable packers 80, 82 are connected to a port collar 84 positioned between the packers. The packers 80, 82 can be located to straddle a formation "thief zone" a busted pipe, or any zone which the well operator desires to isolate. In FIG. 8, profile collars 86, 88 & 90 are respectively located below the packers and port collar to illustrate the use of weight set inflation tool as disclosed in U.S. Pat. No. 5,082,062 in this system.

Figure 9:
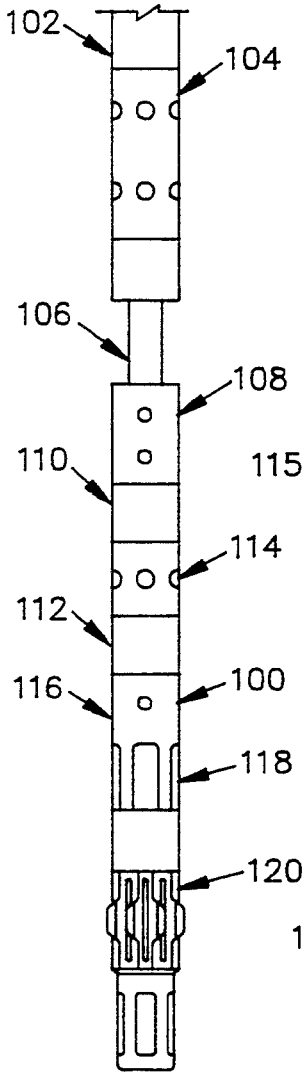
FIG. 9 is a schematic illustration of a weight set straddle inflation tool for use with inflatable packers and the hydraulic port collar.

As shown in FIG. 9, a weight set inflation tool 100 can be located or suspended in a well bore on a string of tubing 102. The tubing string 102 is connected to a pressure operated reverse circulation valve 104. The circulation valve 104 is connected to a central tubular activating member 106. The activating member 106 is slidably received in an upper expander collar 108. Below the expander collar 108 are upper and lower packer elements 110, 112 which straddle a valve port 114. A lower expander member 116 connects to anchor means 118 and to a locating means 120.

Figure 10:
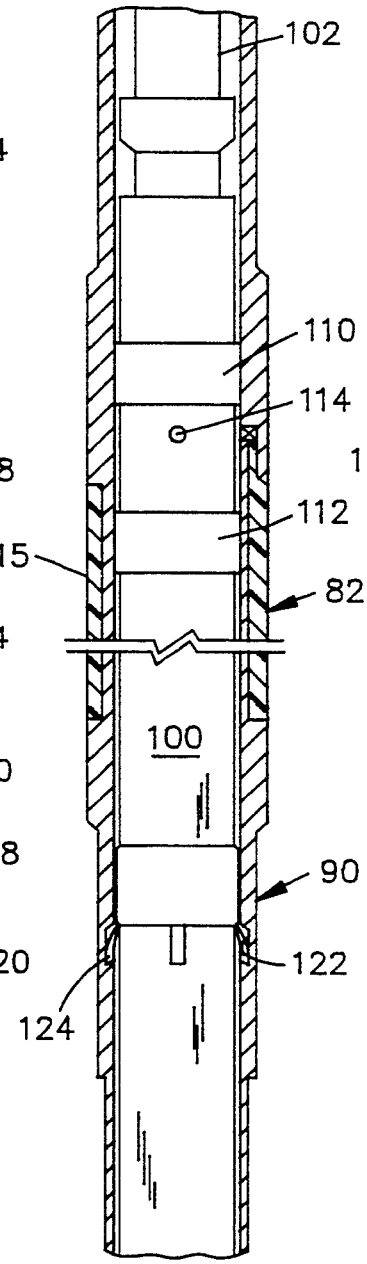
FIG. 10 is a schematic illustration of an inflatable packer and weight set straddle tool in an operational condition.

The profile subs 86, 88, 90 include an inner annular latching groove 122 (See FIG. 10 for example) which cooperates with dog members 124 on the inflation tool 100 (See FIG. 10). In typical arrangement shown in FIG. 10, the dog members 124 are resiliently biased outwardly so that upon downward movement, the projecting ends of the dog members engage the profile groove 122 and the packer elements 110, 112 can be expanded by applied weight on the string of tubing 102.

When the packer elements 110, 112 are expanded, a valve means (not shown) in the tool 100 is activated so that a cement slurry in the string of tubing can be pumped through valve ports 114 to inflate an inflatable packer element 115 on the packer 82.

Figure 11:
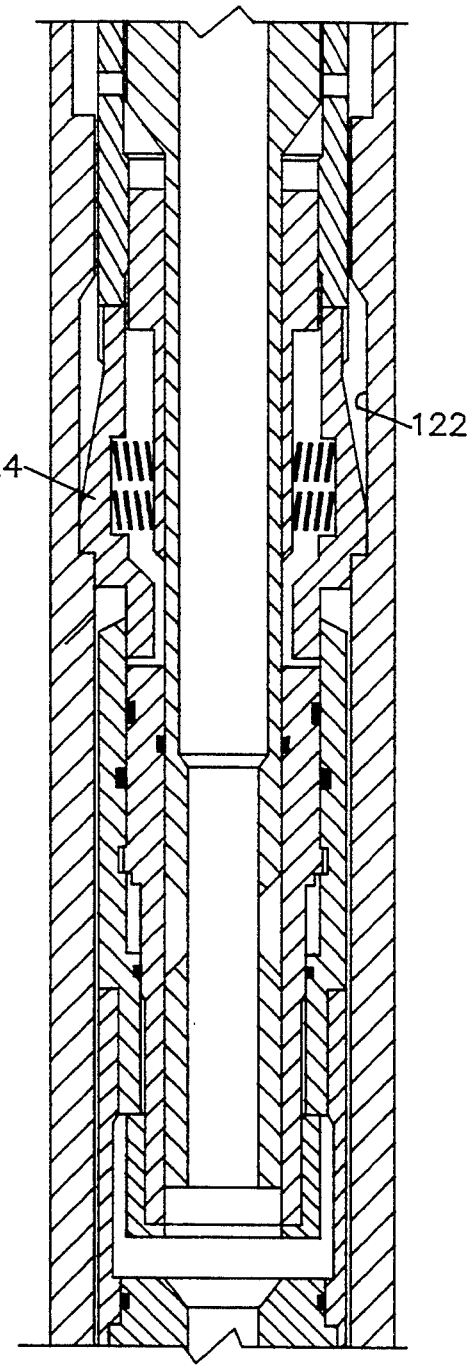
FIG. 11 is a cross-section view showing the anchor means for the weight set straddle tool of FIGS. 9 & 10.

In the above described system, the dog member 124 are normally retained within the housing while the tool is run in the well bore. After disposing the tool below the lowermost profile, the dog members are released to be resiliently biased outwardly (See FIG. 11 for details). The tool is operated from the lowermost profile upwardly by raising the dog members above a profile recess and moving downward which causes the dog members to engage the recessed so the packer elements can be set by weight .

In practicing the method using the arrangement of FIG. 8, the lowermost packer 90 is first inflated. Next the tool is raised to the upper expandable packer 86 and this packer is inflated. The cement slurry is reversed out (by use of a circulation valve, not shown) and the tool is retrieved. The dog members 124 are reset and the tool makes a second trip in the well bore and is activated to release the dog members 124 just below the port collar profile 84. The dog members 124 are then engaged with the profile sub 84 and the valve in the tool 100 is activated to access a cement slurry in the string of tubing into the annulus exterior of the port collar. When the cementing is completed, the tool 100 is raised and then lowered so that the dog members 124 engage the shoulder 56 on the inner sleeve and close the inner valve member 50. When the locating dogs engage the recess 56, the bore of the recess 56 limits outward travel of the dogs so that the dogs do not free the slide valve in the tool. Thus, the inner sleeve can be activated while the slide valve in the tool remains closed so that no cement is accidentally released into the well and the straddle pack-offs cannot be set. The circulation valve is opened and cement in the string of tubing is reversed out leaving no cement in the well bores.

It should be appreciated that the cup-type tool can perform the steps of inflating the inflatable packers and injecting cement slurry through the port collar with one trip in the well bore. Whether a cup type tool or weight set tool is utilized is dictated many times by well conditions where one tool will perform superior to the other because of many factors. In any event, by appropriately locating the profiles relative to the packers, either tool can be used as the situation may dictate.

It will be apparent to those skilled in the art that various changes may be made in the invention without departing from the spirit and scope thereof and therefore the invention is not limited by that which is enclosed in the drawings and specification, but only as indicated in the appended claims.

I claim:

1. A valve apparatus for use in cementing operations in a well bore, said valve apparatus including:

a tubular valve member having flow ports located intermediate of its length, said valve member being adapted for connection in a well string;

an outer valve sleeve means slidably mounted on said valve member, said valve sleeve means having overlapping, longitudinally movable, telescoping sleeve members and seal elements for sealing off said flow ports in an overlapping position of said sleeve members, said sleeve members being responsive to pressure in the interior of the valve member for moving said sleeve members longitudinally to a separated position where said flow ports are opened, annular seal means on said valve member located to one side of said flow ports for cooperating with one of said sleeve members located on the other side of said flow ports upon movement of said one sleeve member into sealing engagement with said seal means for sealing off said flow ports; and an inner sleeve member slidably disposed in the bore of said valve member, said inner sleeve member being movable longitudinally between a first position where said flow ports are open and a second position where said inner sleeve member closes off said flow ports.

2. The valve apparatus as set forth in claim 1 and further including releasable locking means for locking said inner sleeve member in said first and second positions.

3. The valve apparatus as set forth in claim 2 wherein said locking means includes collet fingers releaseably received in an annular recess means.

4. The valve apparatus as set forth in claim 2 wherein said locking means includes a shear pin and includes a snap ring for receipt in a locking recess.

5. The valve apparatus as set forth in claim 1 and further including spring means on said valve member for resiliently urging said one sleeve member into the sealing engagement with said seal means.

6. A valve apparatus for use in cementing operations in a well bore, said valve apparatus including:

a tubular valve member having flow ports located intermediate of its length, said valve member being adapted for connection in a well string;

an outer valve sleeve means slidably mounted on said valve member, said valve sleeve means having overlapping, longitudinally movable, telescoping sleeve members and seal elements for sealing off said flow ports in an overlapping position of said sleeve members, said sleeve members being responsive to pressure in the interior of the valve member for moving said sleeve members longitudinally to a separated position where said flow ports are opened, annular seal means on said valve member located to one side of said flow ports for cooperating with one of said sleeve members located on the other side of said flow ports upon movement of said one sleeve member into sealing engagement with said seal means for sealing off said flow ports;

spring means on said valve member for resiliently urging said one sleeve member into the sealing engagement with said seal means upon removal of pressure in the interior of the valve member; and an inner sleeve member slidably disposed in the bore of said valve member, said inner sleeve member being movable longitudinally between a first position where said flow ports are open and a second position where said inner sleeve member closes off said flow ports, said inner sleeve member having an internal shoulder for engagement with a mechanical device in said bore for moving said inner sleeve member.

7. The valve apparatus as set forth in claim 6 and further including releasable locking means for locking said inner sleeve member in said first and second positions.

8. The valve apparatus as set forth in claim 7 wherein said locking means includes collet fingers releaseably received in the annular recess means.

9. The valve apparatus as set forth in claim 8 and further including shear means for releasable connecting said sleeve members to one another.

10. The valve apparatus as set forth in claim 9 and further including release means for releasable connecting said sleeve members to said valve member.

11. Apparatus for use in a well bore traversing earth formations comprising:

an inflatable packer means having an inflatable packer element with access to an inflation valve in the bore of said packer means, said inflation valve being responsive to a liquid supplied under a first pressure in the bore for inflating into sealing contact with the wall of a well bore;

a hydraulic port collar coupled to said packer, said port collar having a tubular valve member with flow ports located intermediate of its length, said valve member being adapted for connection in a well string;

an outer valve sleeve means slidably mounted on said valve member, said valve sleeve means having overlapping, longitudinally movable, telescoping sleeve members and seal elements for sealing off said flow ports in an overlapping position of said sleeve members, said sleeve members being responsive to liquid supplied under a second pressure in the interior of the valve member for moving said sleeve members longitudinally to a separated position where said flow ports are opened and where the second pressure is greater than the first pressure;

release means for retaining said sleeve members in the overlapping position until a second pressure occurs;

annular seal means on said valve member located to one side of said flow ports for cooperating with one of said sleeve members located on the other side of said flow ports upon movement of said one sleeve member into sealing engagement with said seal means for sealing off said flow ports.

12. The apparatus as set forth in claim 11 and further including spring means on said valve member for resiliently urging said one sleeve member into the sealing engagement with said seal means.

13. The apparatus as set forth in claim 12 and further including a latching recess member for each of said inflatable packer and hydraulic port collar, said recess members being located relative to said inflation valve and said flow ports respectively so that a tubing string inflation tool can be used to supply liquid to said inflatable packer and said hydraulic port collar.

14. The apparatus as set forth in claim 13 wherein the apparatus includes at least two inflatable packers disposed above and below the hydraulic port collar and a latching recess member for each of said packers and the hydraulic port collar.

15. A method for displacing a liquid cement slurry into a well bore annulus at a location along a string of pipe where a pressure operated valve is at the location, comprising the steps of:

disposing a string of pipe with a pressure operated valve at a location in a well bore where it is desired to introduce a liquid cement slurry into the annulus above said location;

supplying a liquid cement slurry to the location through the string of pipe and developing a pressure sufficient to longitudinally displace outer sleeve members on said pressure operated valve to open flow ports in the pressure operated valve and forcing the liquid cement slurry through the flow ports into the annulus;

upon forcing a desired volume of liquid slurry into the annulus, shifting an inner valve sleeve in the pressure operated valve to close the open flow ports internally of the pressure operated valve and shifting the outer sleeve members with respect to the flow ports.

16. A method for cementing a liner in a well bore comprising the steps of:

disposing an inflatable packer in a well bore with a liner to a location where the packer is to be inflated and where it is desired to displace cement into the annulus above the packer;

displacing an inflation liquid down the liner under sufficient pressure and inflating said packer with said inflation liquid;

displacing liquid cement slurry down the liner to a location above the inflated packer to a pressure operated valve in the liner;

developing a pressure sufficient on said liquid cement slurry after the packer is inflated to longitudinally displace outer sleeve members on said pressure operated valve and open flow ports in the pressure operated valve;

forcing the other liquid cement slurry through the flow ports into the annulus between the liner and the well bore;

shifting an inner valve sleeve in the pressure operated valve to close the open flow ports internally of the pressure operated valve and shifting at least one outer sleeve member longitudinally to a position closing the flow ports.

17. A method for cementing a liner in a well bore comprising the steps of:

disposing an inflatable packer and a hydraulic port collar in a well bore with a liner to a location where the packer is to be inflated and where it is desired to displace cement into the annulus about the port collar and where the inflatable packer has a pressure actuated inflation valve and said port collar has a pressure actuated flow port valve and where said valves are located relative to profile recesses respectively associated with the inflatable packer and with the port collar;

passing an inflation tool through the liner by a string of tubing and locating the inflation tool with respect to the profile recess associated with the inflatable packer and isolating the pressure actuated inflation valve on the inflatable packer with the inflation tool;

opening a valve means in the inflation tool to access the string of tubing to the inflation valve and displacing an inflation liquid down the string of tubing under sufficient pressure for inflating said packer with said inflation liquid;

closing the valve means in the inflation tool and moving the inflation tool to locate the inflation tool with respect to the profile recess associated with the hydraulic port collar;

opening the valve means in the inflation tool to access the string of tubing to the hydraulic port collar and displacing liquid cement slurry down the string of tubing with sufficient pressure to open said hydraulic port collar and to inject liquid cement slurry into the annulus exterior of the hydraulic port collar;

discontinuing the pressure on the liquid cement slurry when a sufficient volume of liquid slurry is in the annulus;

closing the hydraulic port valve; and closing the valve means in the inflation tool so that cement slurry is not left in the liner.

18. The method as set forth in claim 17 wherein the closing of the hydraulic port valve is accomplished with an external valve sleeve member on the exterior of the port collar and by shifting the inflation tool after the valve means in the inflation tool is closed to move an internal valve sleeve member in the interior of the port collar to a closed position.

19. The method as set forth in claim 17 and further including the step of moving the inflation tool to a blank section of liner and reversing out and cement slurry remaining in the string of tubing.

20. A method for cementing in a well bore comprising the steps of:

disposing inflatable packers above and below a hydraulic port collar with a liner at a location in a well bore where the packers are to be inflated and where it is desired to displace cement into the annulus about the port collar and between the inflatable packers and where the inflatable packers have a pressure actuated inflation valve and said port collar has a pressure actuated flow port valve and where said valves are located relative to profile recesses respectively associated with the inflatable packers and with the port collar;

passing an inflation tool through the liner by a string of tubing and locating the inflation tool with respect to the profile recess associated with one of the inflatable packers and isolating the pressure actuated inflation valve on the one inflatable packer with the inflation tool;

opening a valve means in the inflation tool to access the string of tubing to the inflation valve in the one inflatable packer and displacing an inflation liquid down the string of tubing under sufficient pressure for inflating said one inflatable packer with said inflation liquid;

after inflating the one inflatable packer, closing the valve means in the inflation tool and relocating the inflation tool with respect to the profile recess associated with the other of the inflatable packers and isolating the pressure actuated inflation valve on the other inflatable packer with the inflation tool;

opening the valve means in the inflation tool to access the string of tubing to the inflation valve in the other inflatable packer and displacing an inflation liquid down the string of tubing under sufficient pressure for inflating said other inflatable packer with said inflation liquid;

closing the valve means in the inflation tool and moving the inflation tool to locate the inflation tool with respect to the profile recess associated with the hydraulic port collar;

opening the valve means in the inflation tool to access the string of tubing to the hydraulic port collar and displacing liquid cement slurry down the string of tubing with sufficient pressure to open said hydraulic port collar and to inject liquid cement slurry into the annulus exterior of the hydraulic port collar;

discontinuing the pressure on the liquid cement slurry when a sufficient volume of liquid slurry is in the annulus;

closing the hydraulic port valve; and closing the valve means in the inflation tool so that cement slurry is not left in the liner.

21. The method as set forth in claim 20 wherein the closing of the hydraulic port valve is accomplished with an external valve sleeve member on the exterior of the port collar and by shifting the inflation tool after the valve means in the inflation tool is closed to move an internal valve sleeve member in the interior of the port collar to a closed position.

22. The method as set forth in claim 20 and further including the step of moving the inflation tool to a blank section of liner and reversing out and cement slurry remaining in the string of tubing.

23. The method as set forth in claim 18 wherein the inflatable tool is removed from the liner after inflating the inflatable packers and is then relocated in the liner with respect to the profile recess associated with the hydraulic port collar so that the cement slurry is introduced to the annulus exterior to the hydraulic port collar on a second trip into the liner.

* * * * *